US006111474A

United States Patent [19]

Nibe

[11] Patent Number: 6,111,474

[45] Date of Patent: Aug. 29, 2000

[54] LOW-NOISE AMPLIFYING DEVICE

[75] Inventor: Masayuki Nibe, Yao, Japan

[73] Assignee: Sharp Kabushiki Kaisha, Osaka, Japan

[21] Appl. No.: 09/199,428

[22] Filed: Nov. 25, 1998

[30] Foreign Application Priority Data

Nov. 27, 1997 [JP] Japan ..... 9-325891

[51] Int. Cl.[7] ..... H01P 5/107

[52] U.S. Cl. ..... 333/26; 330/66; 333/246

[58] Field of Search ..... 330/65, 66, 67, 330/68; 333/26, 33, 238

[56] References Cited

U.S. PATENT DOCUMENTS

| | | | |
|---|---|---|---|
| 3,638,148 | 1/1972 | Hallford et al. | 333/33 X |
| 4,631,505 | 12/1986 | Schiavone | 333/33 |
| 4,675,623 | 6/1987 | Nowak et al. | 333/26 |
| 5,280,253 | 1/1994 | Deki et al. | 333/26 |

FOREIGN PATENT DOCUMENTS

| | | | |
|---|---|---|---|
| 0551556A1 | 7/1993 | European Pat. Off. . | |
| 52-75249 | 6/1977 | Japan | 333/26 |
| 61-210702 | 9/1986 | Japan | 333/26 |
| 1-103002 | 4/1989 | Japan | 333/26 |
| 3-232301 | 10/1991 | Japan | 333/26 |
| 5267914A | 10/1993 | Japan . | |
| 9148808A | 6/1997 | Japan . | |
| 1334225 | 8/1987 | U.S.S.R. | 333/26 |

*Primary Examiner*—Paul Gensler

[57] ABSTRACT

In a low-noise amplifying device, an antenna point is attached to a tip portion of a microstrip line and an end surface of a printed wiring board. The printed wiring board is fixed to a chassis by a screw, a rivet, a projecting portion of a frame or a conductive adhesive in the vicinity of a connection of the antenna pin to the microstrip line. Thereby, even a slight warp that might exist on the board is corrected, so that adhesion between the board and the chassis is reinforced and the low-noise amplifying device stably operates.

20 Claims, 12 Drawing Sheets

LOW-NOISE AMPLIFYING DEVICE

BACKGROUND OF THE INVENTION

The present invention relates to a low-noise amplifying device for use in a satellite broadcasting receiver, and particularly to an LNB (Low Noise Block downconverter), an antenna unit and the like.

FIG. 17 shows a block diagram of a typical satellite broadcasting receiving device. This satellite broadcasting receiving device is constructed of a receiving antenna 1, an outdoor unit 2, an indoor unit 3 and a display device 4 such as a television receiver or the like. The receiving antenna 1 receives and collects a faint radio wave from a broadcasting satellite and thereafter feeds the same to the outdoor unit 2. The outdoor unit 2 is constructed of an LNB (Low Noise Block Downconverter) 5, which low-noise-amplifies the faint radio wave fed from the receiving antenna 1, frequency-converts the resulting signal into an IF (Intermediate Frequency) band and supplies the resulting low-noise signal of a sufficient level to the indoor unit 3 connected as a next stage. The indoor unit 3 is constructed of a DBS (Digital Broadcasting Satellite) tuner 6, an FM Frequency Modulation) demodulator 7, a video and audio signal processing circuit 8 and an RF (Radio Frequency) modulator 9. Then, the signal is group-converted converted into a 1-GHz band by the LNB 5. A desired channel is selected from reception channels given from a coaxial cable 10 and converted into a second intermediate frequency so as to be easily processed. A baseband signal is extracted by the FM demodulator 7 and separated into a video signal and an audio signal. The separated signals are processed and RF-modulated and thereafter outputted to the display device 4.

FIG. 18 is a circuit block diagram of a LNB for domestic CS (Communication Satellite) reception that serves as a LNB for general Ku-band (10 GHz to 13 GHz) reception. An arriving signal of an input frequency of 12.2 GHz to 12.75 GHz is received by an antenna probe 12 inserted in a waveguide 11, low-noise-amplified by an LNA (Low Noise Amplifier) 13 and thereafter passed through a BPF (Band Pass Filter) 14 that allows the desired frequency band to pass, and which removes a signal in the image frequency band. The resulting signal is thereafter mixed by a mixer circuit 15 with an oscillation signal of 11.2 GHz. The oscillation signal has been outputted form a local oscillator 16, and through a BPF 17 and frequency-converted into a signal in an IF band of 1000 MHz to 1550 MHz. Then, the resulting mixed signal is amplified by an IF amplifier circuit 18 so as to have appropriate noise and gain characteristics, and is outputted from an output terminal 19. It is to be noted that the reference numeral 20 denotes a power supply.

FIG. 19 is a circuit block diagram of a LNB for domestic COMETS (Communications and Broadcasting Engineering Satellite) reception that serves as a LNB for Ka-band (17 GHz to 23 GHz) reception. An arriving signal having an input frequency of 20.4 GHz to 21.0 GHz is received by an antenna probe 22 inserted in a waveguide 21, low-noise-amplified by an LNA 23 and thereafter inputted to a mixer circuit 25 after being subjected to image removal. Then, the resulting signal is mixed by the mixer circuit 25 with an oscillation signal of 18.7 GHz; the oscillation signal having been outputted from a local oscillator 26, passed through a BPF 27 and frequency-converted into a signal of an intermediate frequency band of 1700 MHz to 2300 MHz. Then, the resulting mixed signal is amplified by an IF amplifier circuit 28 so as to ensure appropriate noise and gain characteristics, and is outputted from an output terminal 29. It is to be noted that the reference numeral 30 denotes a power supply.

In regard to the electric characteristics of the LNAs 13 and 23, the noise figure (NF) and the gain generally deteriorate and become sensitive to the characteristics of each element, to characteristics of the board pattern and to variations in structure as the frequency increases. Therefore, a stable operation inevitably becomes hard to achieve in the Ka-band as compared with the Ku-band. Accordingly, in the general process of manufacturing the LNB for Ka-band reception, as shown in FIGS. 20A and 20B, operational stability of a circuit board (PWB: Printed Wiring Board) 31 is achieved by soldering the surface of a ground pattern 32 to a base board 33, and thereafter screwing (not shown) the resulting body to a chassis 34 (i.e., upper planar surface) of the waveguide 21. In this case, a microstrip line 35 is formed on the upper surface of the PWB 31, and the upper end of an antenna pin 37 that constitutes the antenna probe 22, while being inserted in a dielectric body 36 on the chassis 34 side, is electrically connected via a metal plate 38 to the tip of the microstrip line 35.

However, the above LNB for conventional Ka-band reception has had problems as follows.

(1) In the Ka-band, a stricter method for grounding each element is required, as compared to the Ku-band. Therefore, in FIGS. 20A and 20B, the ground pattern 32 of the PWB 31 is soldered to the base board 33 and screwed to the chassis 34 when manufacturing the LNB. However, such a complicated fixation makes the manufacturing process of the LNB for Ka-band reception more difficult than that of the LNB for Ku-band reception, causing a cost increase.

(2) FIG. 21 shows characteristic impedance of a route extending from the antenna probe 22 to the LNA 23 shown in FIGS. 20A and 20B. According to FIG. 21, a portion that belongs to the antenna probe 22 and penetrates the dielectric body 36 is designed so as to have a characteristic impedance Zo of 50 Ω in a coaxial structure. However, a portion that extends through the waveguide wall to a connection to the microstrip line 35 has an inductance component because the portion cannot have a coaxial structure, with the result that a characteristic impedance Zconnect of the portion does not match 50 Ω. Therefore, the characteristic impedance Zconnect matches neither with the characteristic impedance Zo (=50 Ω) in the portion of the antenna probe 22 that touches the dielectric body 36 nor a characteristic impedance Zo (=50 Ω) on the input side of the microstrip line 35. Also, a characteristic impedance Zin of a route extending from the microstrip line 35 to the LNA 23 cannot match to 50 Ωdue to existence of the LNA 23. Therefore, the characteristic impedance Zin is made to match with the Zconnect by correcting the shape of a stub 39 of the microstrip line 35. However, as described above, the LNB for Ka-band reception is sensitive to the characteristics of each element, the PWB pattern and the variation in structure. Therefore, considerable accuracy is required for the adjustment of the above stub, meaning that the matching adjustment of the LNB for Ka-band reception is very difficult.

SUMMARY OF THE INVENTION

Accordingly, the object of the present invention is to provide a low-noise amplifying device that stably operates in the Ka-band and is producible in a factory that has experience in manufacturing the LNB for Ku-band reception.

In order to achieve the above-mentioned object, the present invention provides a low-noise amplifying device having a structure in which an antenna probe comprised of a coaxial structure of a metal rod and a dielectric member is connected on an end surface of a board to a microstrip line that is formed on the board and connected to a low-noise amplifier circuit and receives a radio wave in a Ka-band of 17 GHz to 23 GHz, wherein the board has a lower surface on which a ground pattern is formed, and the board is fixed to a chassis by a fixing member at least in vicinity of a connection of the antenna probe to the microstrip line where a stable gain and a reduced noise figure are obtained, thereby achieving a tight adhesion between the ground pattern and the chassis.

According to the low-noise amplifying device of the present invention, adhesion between the ground pattern and the chassis is increased in the vicinity of the connection of the antenna probe to the microstrip line. Therefore, the grounding surface of the board is stabilized, thereby allowing the low-noise amplification characteristics of the stabilized gain and the reduced noise figure to be obtained.

That is, according to the present invention, there is no need for soldering the board to the baseboard as in the prior art. Accordingly, there is provided a low-noise amplifying device which ensures easy fixation of the board, a high reliability, a producibility through the process having achievements in producing the LNB for Ku-band reception and an excellent cost versus actual performance.

In an embodiment of the present invention, the board is fixed to the chassis by the fixing member in the vicinity of a grounding terminal of an amplifying element constituting the low-noise amplifier circuit where a stable gain and a reduced noise figure are obtained.

According to the above embodiment, adhesion between the ground pattern and the chassis is improved in the vicinity of the grounding terminal of the amplifying elements, so that a low-noise amplifying device having a further stabilized gain and a reduced noise figure is obtained.

In an embodiment of the present invention, the fixing member is a screw.

According to the above embodiment, there are obtained stable low-noise amplification characteristics equivalent to those in the case where the board is soldered to the base board in the prior art.

In an embodiment of the present invention, the fixing member is a rivet provided for the chassis.

According to the above embodiment, the board is fixed to the chassis through the simple operation of spreading the head portion of the rivet. Therefore, the board is fixed to the chassis with high workability.

In an embodiment of the present invention, the fixing member is a frame that is provided for the chassis and extends to an upper surface of the board, and the board is inserted between the frame and the chassis, thereby achieving a tight adhesion between the ground pattern and the chassis.

According to the above embodiment, there is no need for providing the board with a hole through which the screw or the rivet penetrates. Further, the board is fixed to the chassis with a single motion without repeating the screwing or the riveting several times.

In an embodiment of the present invention, the fixing member is a conductive adhesive.

According to the above embodiment, the board is fixed to the chassis applying neither impact nor vibration to the microstrip line and the low-noise amplifier circuit mounted on the board.

In an embodiment of the present invention, a gap is provided between an upper end surface of the dielectric member of the antenna probe and the board.

According to the above embodiment, by changing the amount of this gap, the characteristic impedance of the connection of the antenna probe to the microstrip line is adjusted. Therefore, the impedance matching at the connection of the antenna probe to the microstrip line is easily achieved. That is, according to this embodiment, the NF matching and VSWR (Voltage Standing Wave Ratio) matching are easily corrected and improved.

In an embodiment of the present invention, the dielectric member of the antenna probe is screwed to a waveguide so as to be able to advance and retreat in an axial direction of the metal rod.

According to the above embodiment, the amount of gap between the upper and surface of the dielectric member and the board is be easily adjusted by turning the dielectric member. Therefore, the impedance matching at the connection of the antenna probe to the microstrip line is more easily achieved.

In an embodiment of the present invention, an upper end of the metal rod in the antenna probe is connected to a metal plate attached to a tip of the microstrip line.

According to the above embodiment, the antenna probe is connected to the microstrip line with the simple connection structure.

In an embodiment of the present invention, an upper end of the metal rod in the antenna probe is connected to a tip portion of the microstrip line projecting from the and surface of the board.

According to the above embodiment, the antenna probe is directly connected to the tip portion of the microstrip line, thereby allowing the variation in connection accuracy to be eliminated.

In an embodiment of the present invention, an upper end of the metal rod in the antenna probe is bent, and a side surface of the bent portion of the metal rod is connected to a tip portion of the microstrip line.

According to the above embodiment, the antenna probe is connected directly and firmly to the microstrip line.

In an embodiment of the present invention, an upper end of the metal rod in the antenna probe is provided with a flange, a semicircular cut portion is formed in an end portion of a laminate of the board and the microstrip line, a side surface of an upper portion of the metal rod is fitted in the semicircular cut portion of the laminate of the microstrip line and the board, and part of the flange is connected to the end portion of the microstrip line.

According to the above embodiment, the antenna probe is connected to the microstrip line so as to reduce the variation in connection accuracy through simple work.

In an embodiment of the present invention, the tip portion of the microstrip line is formed into a taper that reduces in width toward the tip.

According to the above embodiment, mismatching of the characteristic impedance of the connection of the antenna probe to the microstrip line is alleviated.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
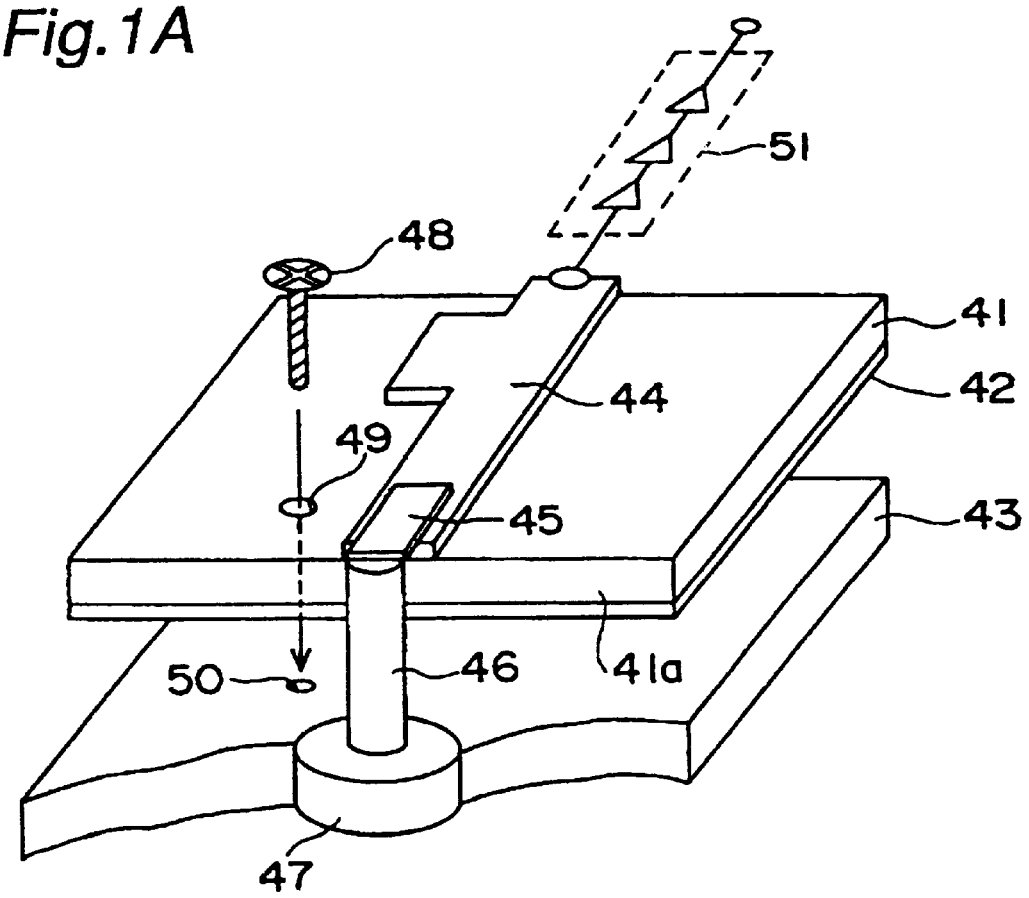
FIGS. 1A and 1B are views showing a PWB fixation structure and a method for fixing PWB in a low-noise amplifying device for Ka-band reception according to the present invention.

The present invention will be described in detail below with reference to the embodiments shown in the drawings.

Figure 1B:
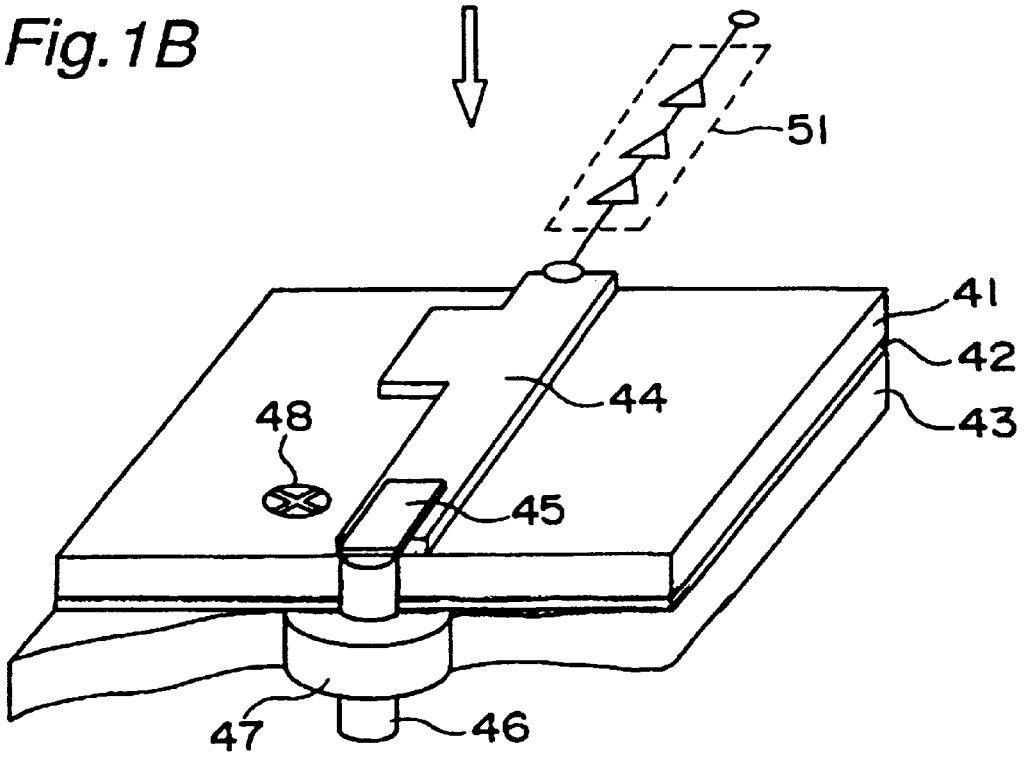

FIGS. 1A and 1B show a PWB fixation structure and a fixing method of a low-noise amplifying device according to the present embodiment. This low-noise amplifying device is applied to a LNB for Ka-band reception. In the low-noise amplifying device for Ka-band reception according to the present embodiment shown in FIGS. 1A and 1B, a microstrip line 44 is formed on the upper surface of a PWB 41, and an end surface of the microstrip line 44 is located on the same surface as an end surface 41*a* of the PWB 41. Further, a metal plate 45 is attached to a tip portion of the microstrip line 44 with the tip portion projecting from the end surface of the microstrip line 44. Then, the upper end surface of an antenna pin 46 made of a metal rod is soldered to the lower surface of the projecting portion of the metal plate 45. The antenna pin 46 is inserted in a ring-shaped dielectric member 47 buried in a chassis 43 (i.e., upper planar surface) of a waveguide, and the dielectric member 47 and the antenna pin 46 forming a coaxial structure constitute an antenna probe.

Then, the PWB 41 is screwed to the chassis 43 with the lower surface of a ground pattern 42 formed on the lower surface of the PWB 41 being put in direct contact with the chassis 43 (see FIG. 1B, for example). Further, a hole 49 through which a screw 48 penetrates is provided through the PWB 41 and the ground pattern 42 in the vicinity of a connection of the antenna pin 46 to the microstrip line 44 via the metal plate 45. A tapped hole 50 is provided in the chassis 43 in correspondence with the position of the hole 49. Then, the screw 48 and the tapped hole 50 are brought in screw engagement, thereby directly connecting the PWB 41 to the chassis 43 in the vicinity of the connection of the antenna pin 46 to the microstrip line 44 via the metal plate 45. In this case, the upper surface of the dielectric member 47 abuts against the surface of the ground pattern 42. It is to be noted that the reference numeral 51 denotes an LNA.

In the low-noise amplifying device for Ka-band reception, grounding of the low-noise amplifying device becomes unstable even if a slight warp exists in the PWB 41. Therefore, it is difficult to obtain stable circuit characteristics merely by directly screwing the PWB 41 to the chassis 43 only at conventional screwing positions. However, according to the present embodiment, by fastening a portion of PWB in the vicinity of the connection of the antenna pin 46 to the microstrip line 44 with the screw 48 in addition to the conventional screwing positions, adhesion in the vicinity of the connection of the antenna pin 46 to the microstrip line 44 between the ground pattern 42 on the PWB 41 and the chassis 43 is reinforced. Accordingly, stable circuit characteristics equivalent to those in the case where the PWB is soldered to the base plate are obtained.

Figure 2:
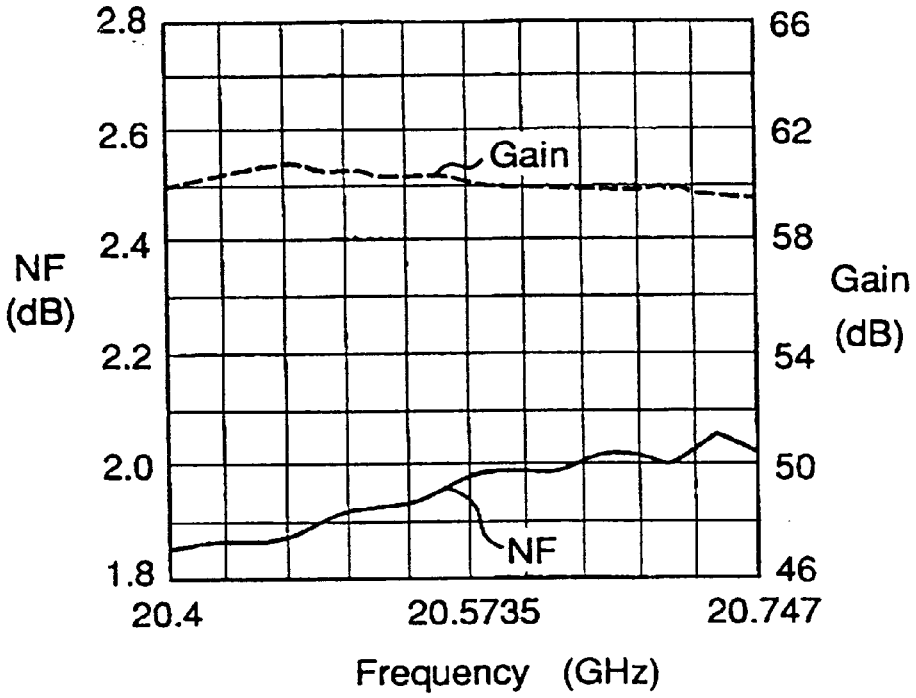
FIG. 2 is a graph showing frequency characteristics of a grain and a noise figure in the low-noise amplifying device shown in FIGS. 1A and 1B.
Figure 3:
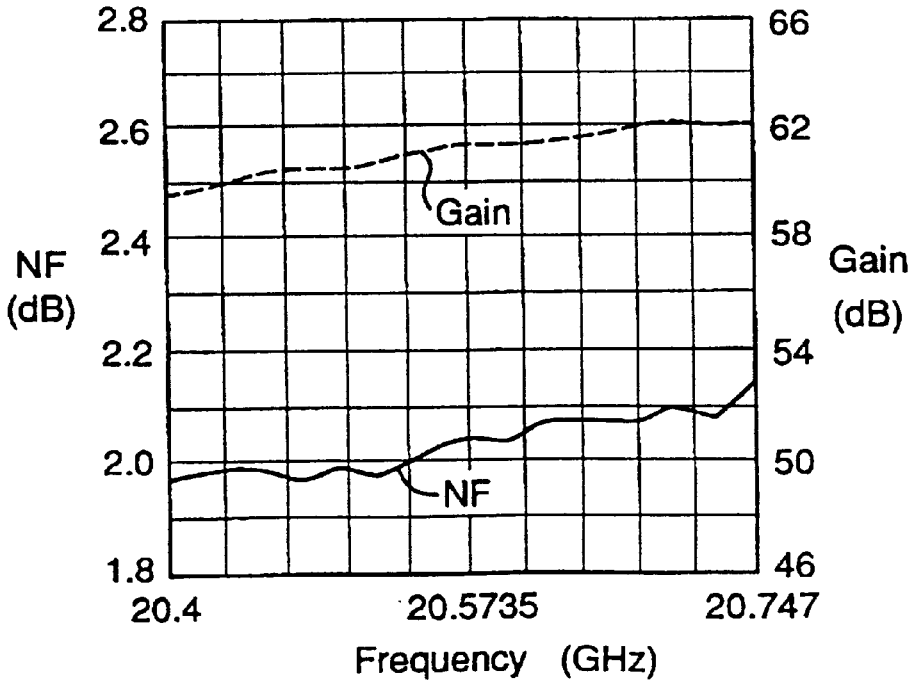
Fig.3 PRIOR ART
FIG. 3 is a graph showing the frequency characteristics of a gain and a noise figure in a prior art low-noise amplifying device for Ka-band reception.

FIG. 2 shows frequency characteristics of a gain and a noise figure (NF) in the low-noise amplifying device for Ka-band reception shown in FIG. 1. FIG. 3 shows frequency characteristics of a gain and a noise figure in the prior art Low-noise amplifying device for Ka-band reception. FIGS. 2 and 3 prove the fact that the low-noise amplifying device of the present embodiment has a more stable gain and an improved noise figure.

Figure 4:
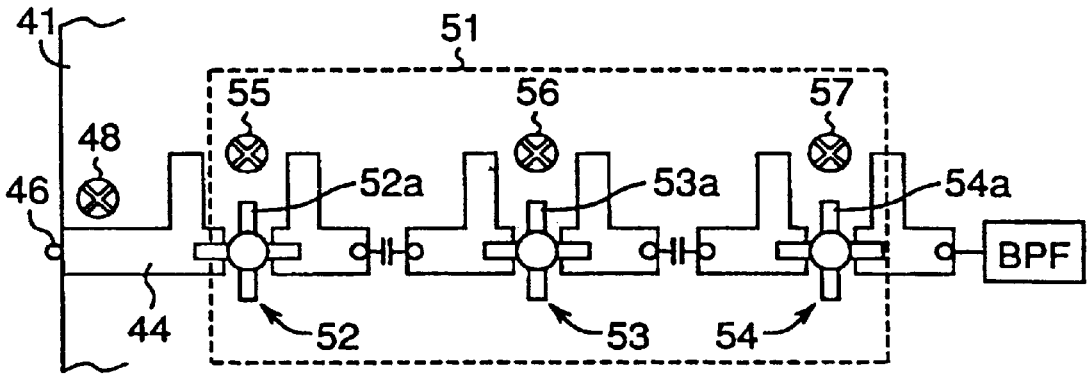
FIG. 4 is an explanatory view of positions at which a PWB is fixed to a chassis in FIGS. 1A and 1B.

FIG. 4 illustrates the positions of which a PWB is fixed to the chassis in FIGS. 1A and 1B. Referring to FIG. 4, there are further provided screwed portions in the vicinity of grounding terminals 52*a*, 53*a* and 54*a* of amplifying elements (HEMTs: High Electron Mobility Transistors) 52, 53 and 54, respectively, constituting the LNA 51 with screws 55, 56 and 57 in addition to the screwing of the PWB 41 to the chassis 43 with the screw 48 in the vicinity of the connection of the antenna pin 46 to the microstrip line 44. With this arrangement, adhesion in the vicinity of the grounding terminals 52*a*, 53*a* and 54*a* of the HEMTs 52, 53 and 54 between the ground pattern 42 and the chassis 43 is improved, thereby allowing for stable operations of the HEMTs 52, 53 and 54. Therefore, circuit characteristics having a further stabilized gain and a reduced noise figure may be achieved.

Although there is illustrated using screws 48, 55, 56 and 57 in the vicinity of the connection of the antenna pin 46 to the microstrip line 44 and in the vicinity of the grounding terminals 52*a,* 53*a* and 54*a* of the HEMTs 52, 53 and 54 as the fixing means in the above description, the present invention is note limited to the use of screws. For example, fixing methods as shown in FIGS. 5A through FIG. 7 may also be used.

Figure 5A:
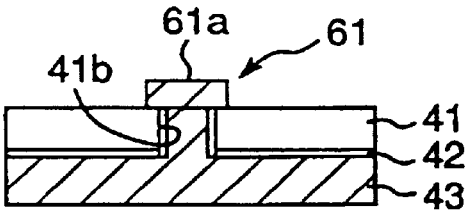
FIGS. 5A and 5B are views showing methods for fixing a PWB to a chassis, different from that of FIGS. 1A and 1B.
Figure 5B:
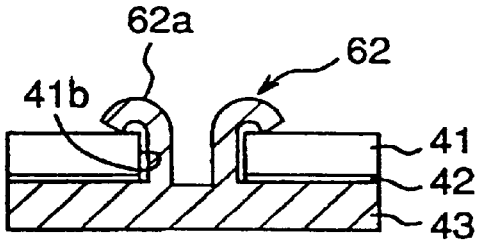

FIGS. 5A and 5B show examples in each of which a rivet is used for the fixation in place of the screw. Referring to FIG. 5A, a pin-shaped rivet 61 is provided on the chassis 43 and put through a hole 41*b* bored through the PWB 41, and a head portion 61*a* is spread to fix the PWB 41. Referring to FIG. 5B, a pipe-shaped rivet 62 is provided on the chassis 43 and put through a hole 41*b* bored through the PWB 41, and a head portion 62*a* is spread to fix the PWB 41.

Figure 6A:
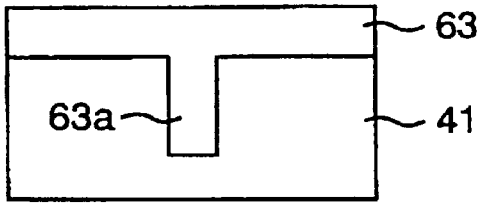
FIGS. 6A, 6B and 6C are views showing a method for fixing a PWB to a chassis, different from those of FIGS. 1A and 1B and FIGS. 5A and 5B.
Figure 6B:
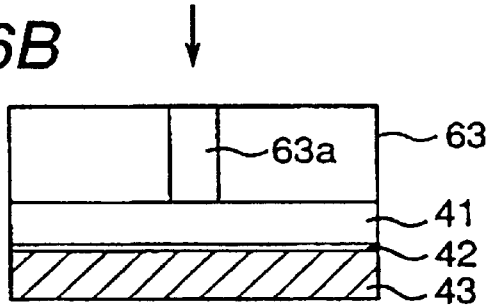
Figure 6C:
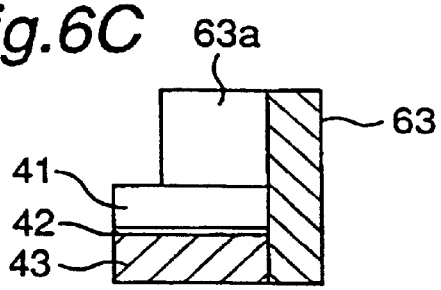

FIGS. 6A, 6B and 6C show an example in which fixation is achieved by a frame. FIG. 6A is a plan view, FIG. 6B is a front view and FIG. 6C is a side view. Part of a frame 63 is made so as to project above the PWB 41 with interposition of a gap corresponding in thickness to the PWB 41 and the ground pattern 42 so that the PWB 41 and the ground pattern 42 can be inserted between the projecting portion 63*a* of the frame 63 and the chassis 43. This projecting portion 63*a* is extended to a portion close to the connection of the antenna pin 46 to the microstrip line 44 or close to the grounding terminals 52*a,* 53*a* and 54*a* of the HEMTs 52, 53 and 54, respectively. Thereby, the PWB 41 and the ground pattern 42 are fixed by inserting the same between the projecting portion 63*a* and the chassis 43.

Figure 7:
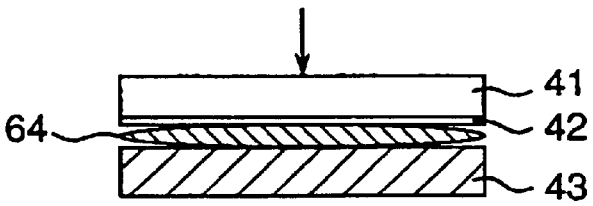
FIG. 7 is a view showing a method for fixing a PWB to a chassis, different from those of FIGS. 1A and 1B, FIGS. 5A and 5B and FIGS. 6A, 6B and 6C.

FIG. 7 shows an example in which the fixation is achieved by an adhesive. A conductive adhesive 64 is applied to the chassis 43 at least in the vicinity of the connection of the antenna pin 46 to the microstrip line 44 or in the vicinity of the grounding terminals 52*a,* 53*a* and 54*a* of the HEMTs 52, 53 and 54. Then, the PWB 41 is laminated and pressurized for fixation.

Figure 8A:
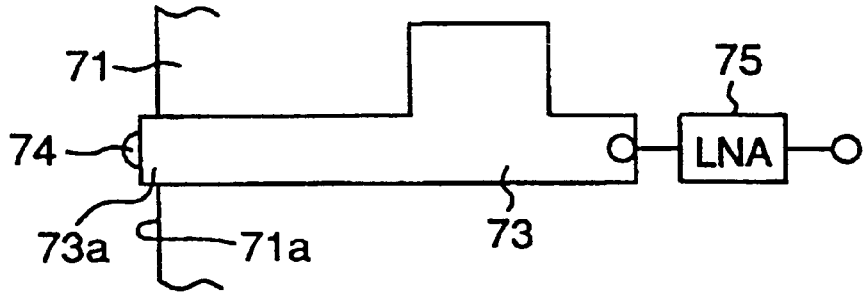
FIGS. 8A and 8B are views showing a method for attaching an antenna pin to a microstrip line, different from that of FIGS. 1A and 1B.
Figure 8B:
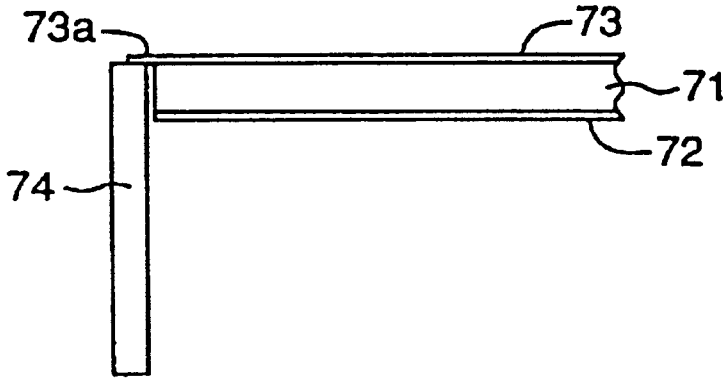

In the present embodiment, as shown in FIGS. 1A and 1B, the upper end of the antenna pin 46 is fixed by soldering to the tip of the microstrip line 44 via the metal plate 45 in the portion of the end surface 41*a* of the PWB 41. With this arrangement, the antenna pin 46 can be attached through a simple process. FIG. 8A through FIG. 11B illustrate how to attach an antenna pin according to other methods. Referring to FIGS. 8A and 8B, an end surface 71*a* of a PWB 71 on the upper surface of which a microstrip line 73 is formed is processed to be cut leaving the microstrip line 73, thereby projecting a tip portion 73*a* of the microstrip line 73 from the end surface 71*a* of the PWB 71. Then, the upper end of an antenna pin 74 is directly soldered to the tip portion 73*a* of the microstrip line 73. According to this method, although a cutting machine of high accuracy is necessary, there is the advantage that a variation in accuracy of connection between the microstrip line 73 and the antenna pin 74 is allowed to be small. It is to be noted that the reference numeral 72 denotes a ground pattern and the reference numeral 75 denotes an LNA.

Figure 9A:
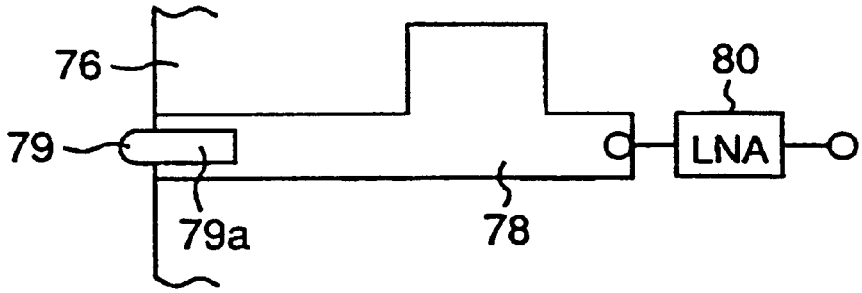
FIGS. 9A and 9B are views showing a method for attaching an antenna pin to a microstrip line, different from those of FIGS. 1A and 1B and FIGS. 8A and 8B.
Figure 9B:
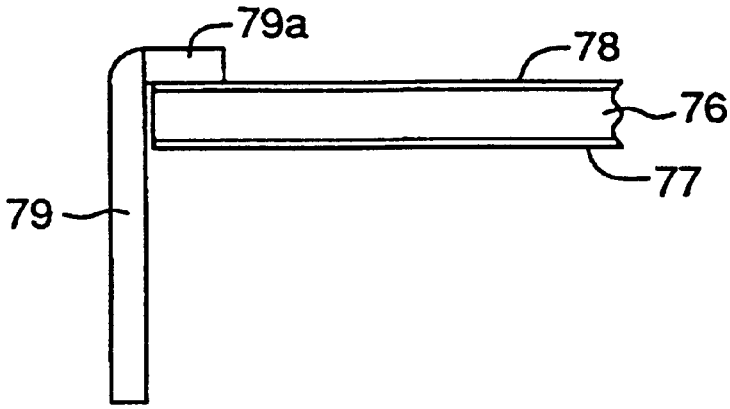

Referring to FIGS. 9A and 9B, a tip portion of an antenna pin 79 is bent at right angles and a side surface of this bent portion 79*a* is directly soldered to the tip of a microstrip line 78 formed on a PWB 76. According to this method, the antenna pin 79 is firmly connected to the microstrip line 78. It is to be noted that the reference numeral 77 denotes a ground pattern and the reference numeral 80 denotes an LNA.

Figure 10A:
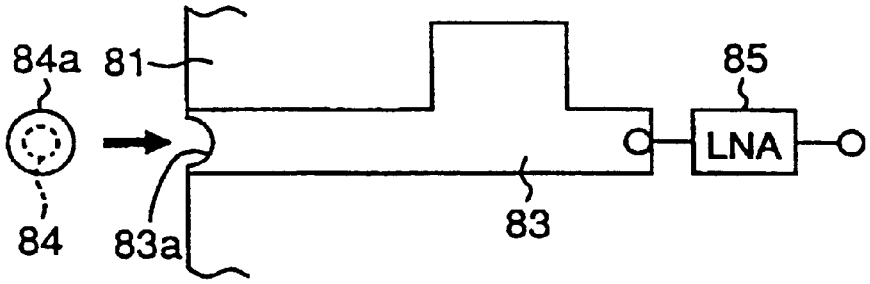
FIGS. 10A and 10B are views showing a method for attaching an antenna pin to a microstrip line, different from those of FIGS. 1A and 1B, FIGS. 8A and 8B and FIGS. 9A and 9B.
Figure 10B:
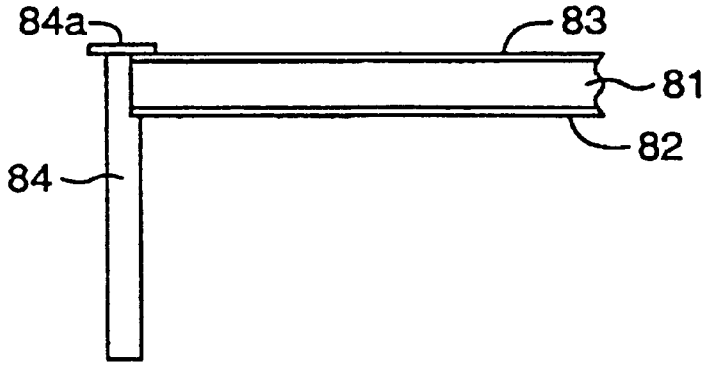

Referring to FIGS. 10A and 10B, a circular flange 84*a* is provided at a tip of an antenna pin 84. There is further provided a semicircular cut portion 83*a* at a tip portion of a PWB 81 and a microstrip line 83 formed on this PWB 81. Then, a side surface of the antenna pin 84 is fitted to this cut portion 83*a,* and the flange 84*a* of the antenna pin 84 is directly soldered to the microstrip line 83. According to this method, there is an advantage that a variation in accuracy of connection between the microstrip line 83 and the antenna pin 84 is allowed to be small in spite of the fact that the manufacturing process is simple. It is to be noted that the reference numeral 82 denotes a ground pattern and the reference numeral 85 denotes an LNA.

Figure 11A:
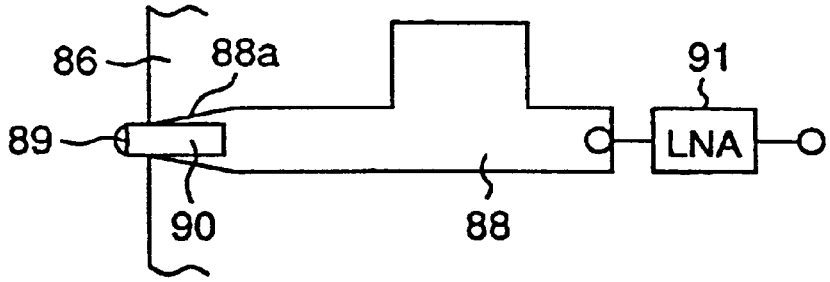
FIGS. 11A and 11B are views showing a method for attaching an antenna pin to a microstrip line, different from those of FIGS. 1A and 1B and FIG. 8A through FIG. 10B.
Figure 11B:
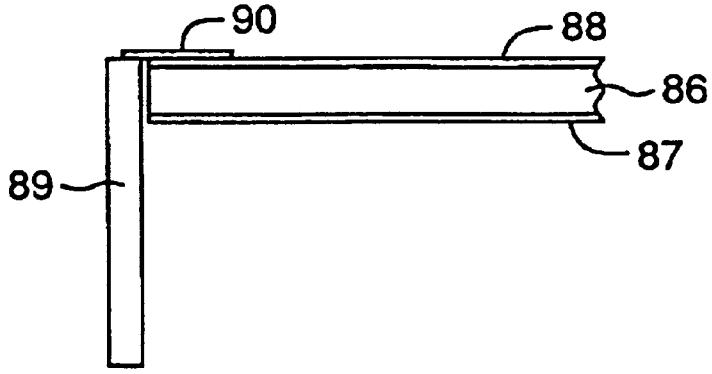
Figure 21:
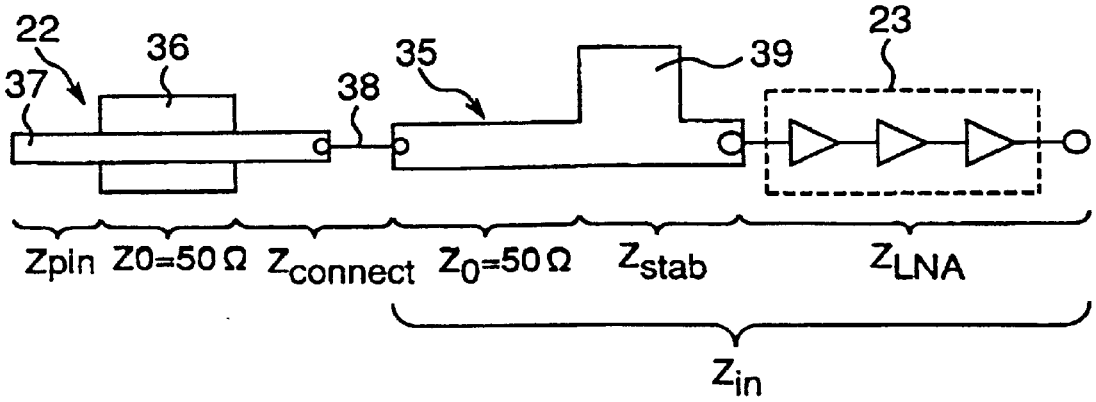
Fig.21 PRIOR ART
FIG. 21 is a view showing a characteristic impedance of a route extending from an antenna probe to an LNA in FIGS. 20A and 20B.

Referring to FIGS. 11A and 11B, similar to the case of FIGS. 1A and 1B, a tip of an antenna pin 89 is soldered to the tip of a metal plate 90 on a microstrip line 88 formed on a PWB 86. It is to be noted that a taper 88*a* is formed toward a tip of the microstrip line 88 and the tip of the microstrip line 88 is made to have a width equal to a diameter of the antenna pin 89. According to this method, there is the advantage that the mismatching of the characteristic impedance Zconnect at the connection portion shown in FIG. 21 can be alleviated. It is to be noted that the reference numeral 87 denotes a ground pattern and the reference numeral 87 denotes a ground pattern and the reference numeral 91 denotes an LNA. It is also acceptable to form a taper at each tip portion of the microstrip lines 73, 78 and 83 shown in FIG. 8A through FIG. 10B.

According to the present embodiments as described above, in the low-noise amplifying device for Ka-band reception of a type in which the antenna pin 46 is attached to the tip of the microstrip line 44 on the end surface 41*a* of the PWB 41, the PWB 41 is fixed to the chassis 43 by means of the fixing members: the screws 48, 55, 56 and 57, the rivets 61 or 62, the projecting portion 63*a* of the frame 63 or the conductive adhesive 64 in the vicinity of the connection of the antenna pin 46 to the microstrip line 44 and in the vicinity of the grounding terminals 52*a,* 53*a* and 54*a* of the HEMTs 52, 53 and 54 constituting the LNA 51. As a result, even a slight warp, which possibly exits in the PWB 41, is corrected, so that adhesion between the ground pattern 42 of the PWB 41 and the chassis 43 is reinforced. Therefore, stable circuit characteristics equivalent to those in the case where a PWB is soldered to the base plate are obtained.

In the above embodiments, the PWB 41 is fixed to the chassis 43 both in the vicinity of the connection of the antenna pin 46 to the microstrip line 44 and in the vicinity of the grounding terminals 52*a,* 53*a* and 54*a* of the HEMTs 52, 53 and 54 constituting the LNA 51. However, it is also acceptable to fix the antenna pin 46 to the microstrip line 44 only in the vicinity of the connection of the antenna pin 46 to the microstrip line 44.

Figure 12A:
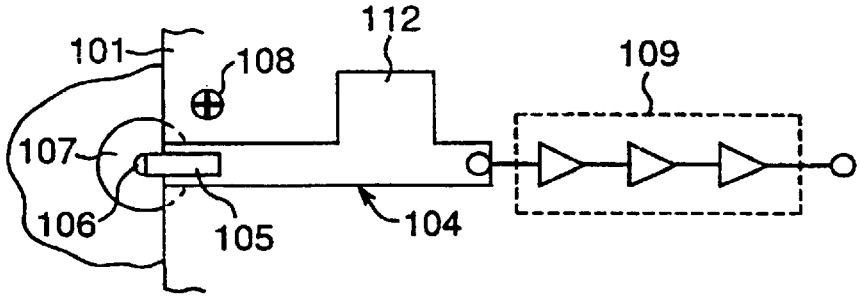
FIGS. 12A and 12B are views showing a PWB fixation structure in a low-noise amplifying device for Ka-band reception different from that of FIGS. 1A and 1B.
Figure 12B:
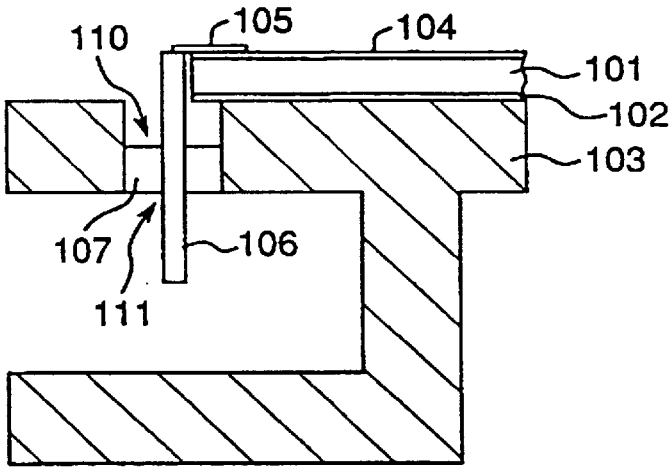

FIGS. 12A and 12B show a Low-noise amplifying device for Ka-band reception of the present embodiment. FIG. 12A is a plan view, and FIG. 12B is a longitudinal sectional view. A PWB 101, a ground pattern 102, a chassis 103, a microstrip line 104, a metal plate 105, an antenna pin 106, a screw 108 and an LNA 109 have the same constructions and operations as those of the PWB 41, ground pattern 42, chassis 43, microstrip line 44, metal plate 45, antenna pin 46, screw 48 and LNA 51, respectively, shown in FIG. 1.

A dielectric member 107 of the present embodiment is formed into a ring-like shape and buried in the chassis 103 of the waveguide, and the antenna pin 106 is put through the dielectric member, similar to the dielectric member 47 of FIG. 1. It is to be noted that the thickness of the dielectric member 107 is made smaller than thickness of the chassis 103, and a gap i.e. cavity portion 110 is provided between the dielectric member 107 and the PWB 101.

Figure 13:
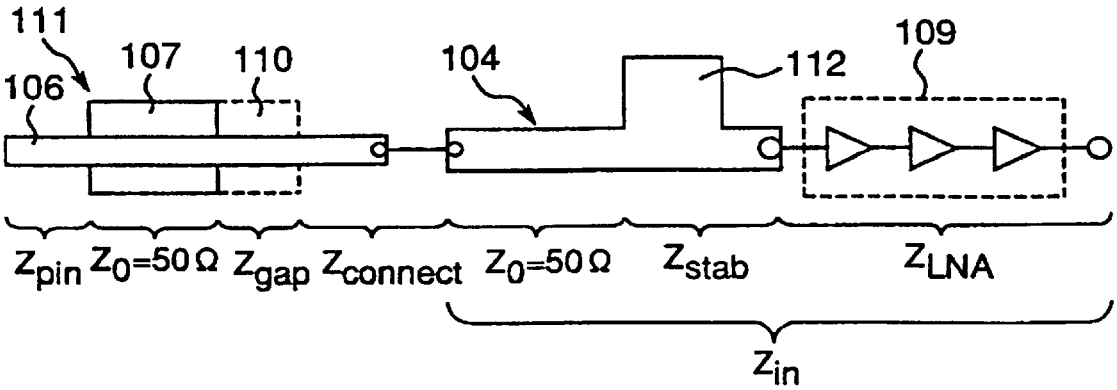
FIG. 13 is a view showing a characteristics impedance of a route extending from an antenna probe to an LNA in FIGS. 12A and 12B.

FIG. 13 shows the characteristic impedance of a route extending from an antenna probe 111 to the LNA 109 shown in FIGS. 12A and 12B. FIG. 13 implies that, by providing the gap portion 110 between the coaxial portion of the antenna probe 111 and the PWB 101, an impedance Zgap is adjusted by varying a volume of this gap portion 110. Accordingly, the characteristic impedance Zconnect of the portion extending through the chassis 103 to the connection to the microstrip line, which has conventionally been unable to achieve matching only with the shape correction of a stub 112, is provided with a correction term of Zgap. Thereby, the characteristic impedance Zconnect matches the characteristic impedance Zo (=50 Ω) in the coaxial portion of the antenna probe 111 and on the input side of the microstrip line 104.

Figure 14:
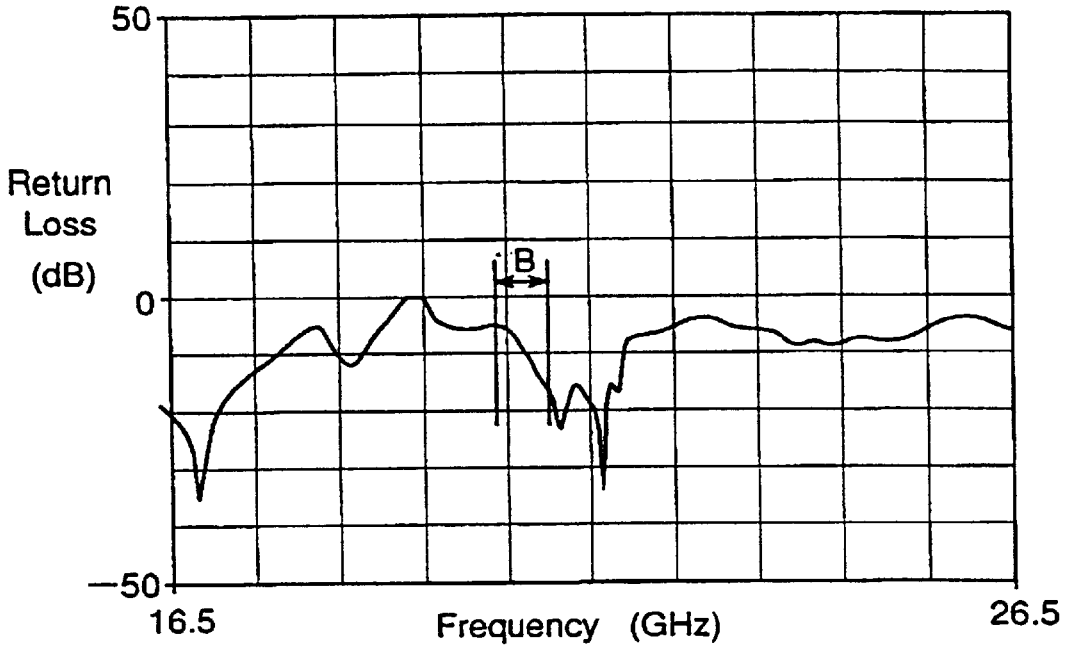
FIG. 14 is a graph showing an input return loss measurement result in the low-noise amplifying device shown in FIGS. 12A and 12B.
Figure 15:
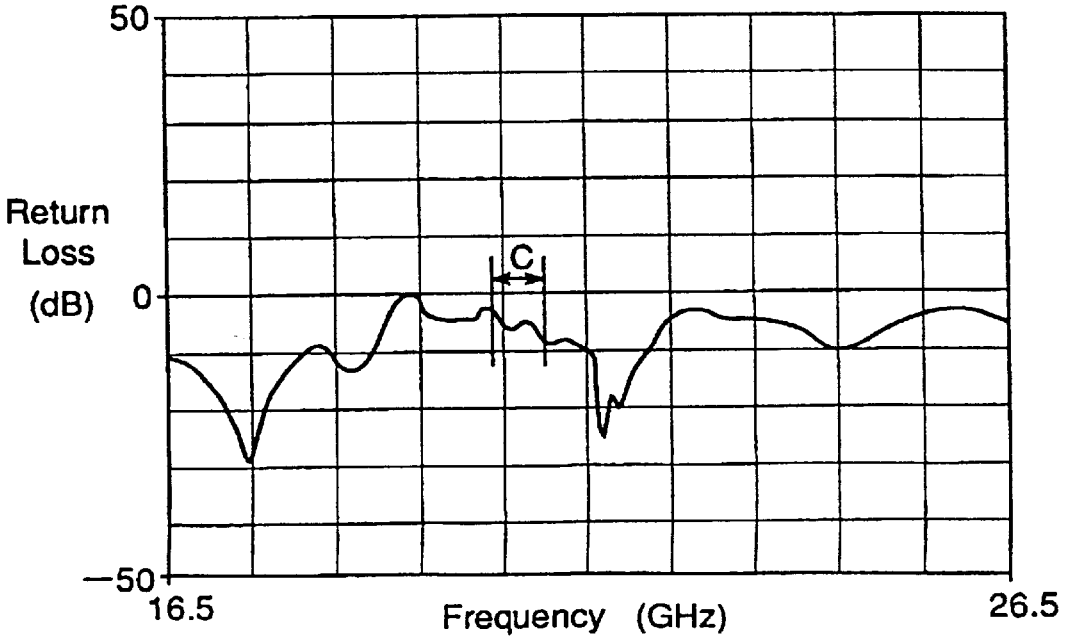
Fig.15 PRIOR ART
FIG. 15 is a graph showing an input return loss measurement result in a prior art low-noise amplifying device for Ka-band reception.

FIG. 14 shows a measurement result of an input return loss in the Low-noise amplifying device for Ka-band reception shown in FIGS. 12A and 12B. FIG. 15 shows a measurement result of an input return loss in the prior art Low-noise amplifying device for Ka-band reception. FIGS. 14 and 15 illustrate that the input return loss of the low-noise amplifying device of the present embodiment is improved more in the bands B and C that are often used among Ka-bands.

Figure 16:
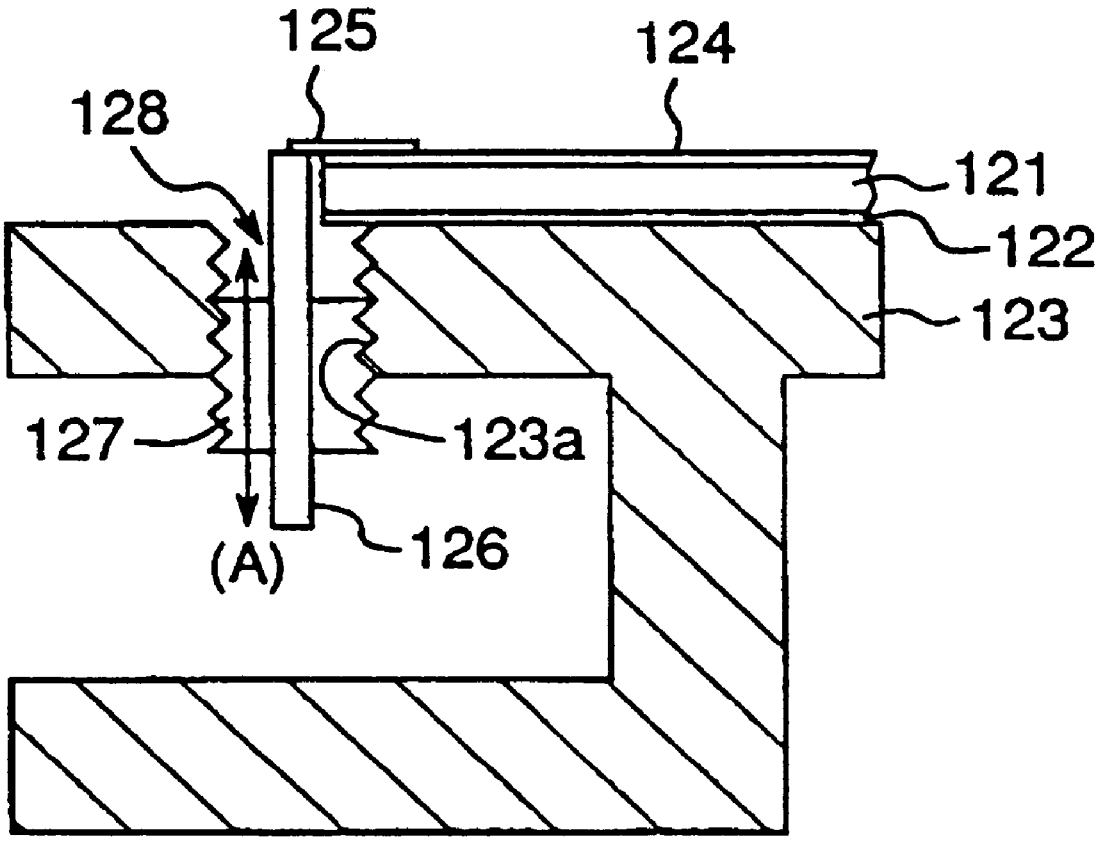
FIG. 16 is a longitudinal sectional view of a low-noise amplifying device for Ka-band reception different from those of FIGS. 1A and 1B and FIGS. 12A and 12B.
Figure 17:
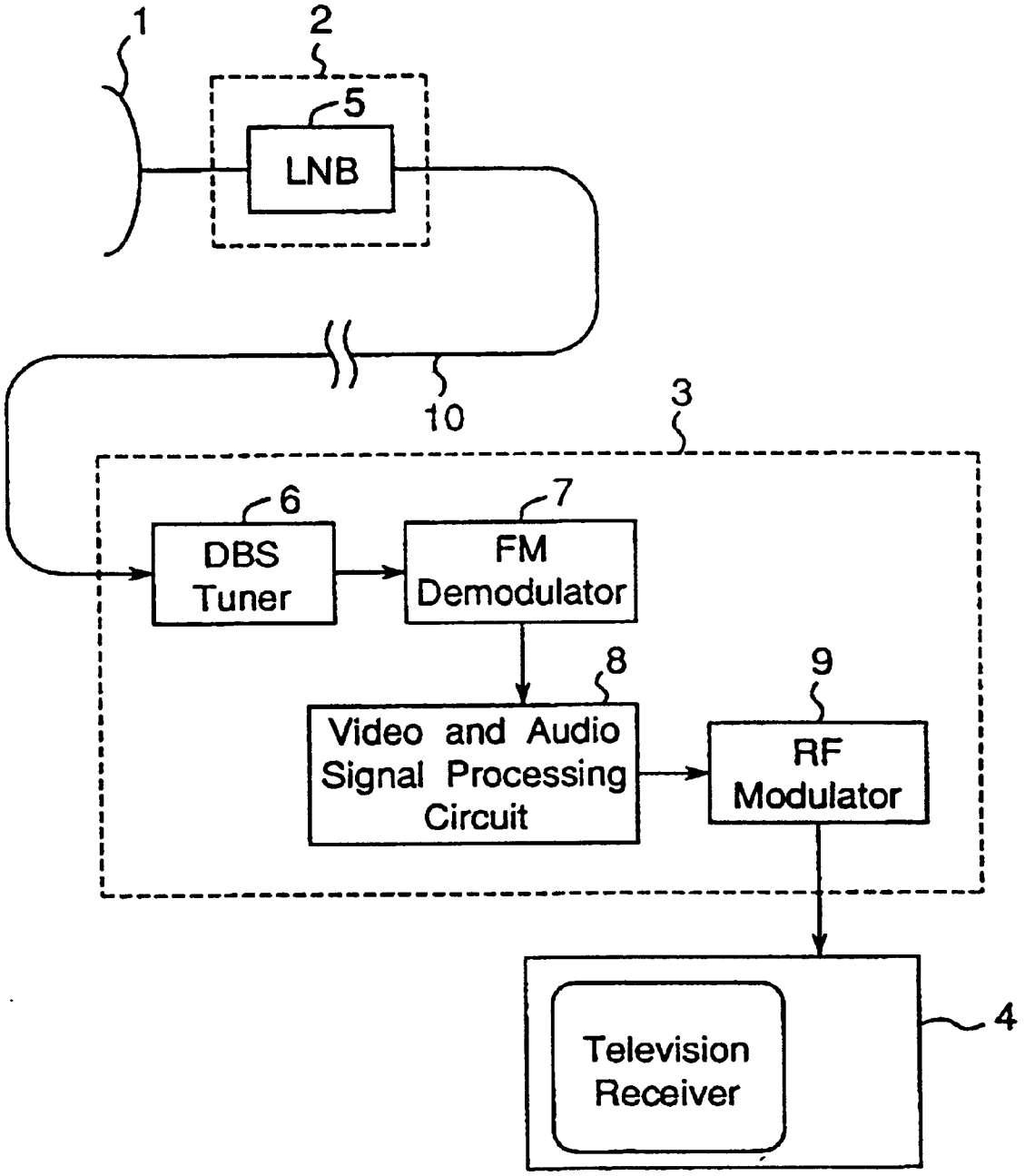
Fig.17 PRIOR ART
FIG. 17 is a block diagram showing an example of a satellite broadcasting receiving device.
Figure 18:
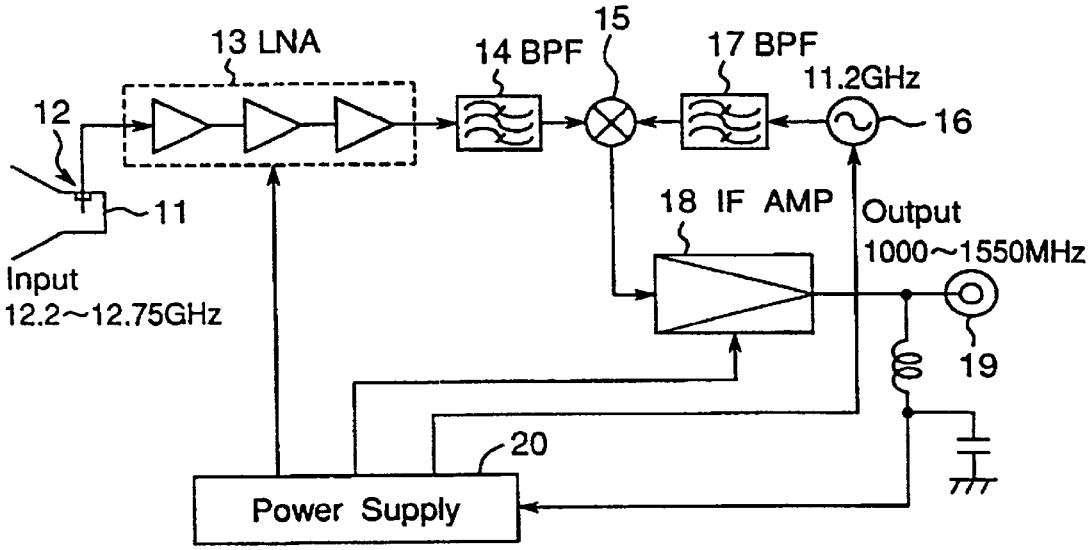
Fig.18 PRIOR ART
FIG. 18 is a circuit block diagram of a LNB for domestic CS reception.
Figure 19:
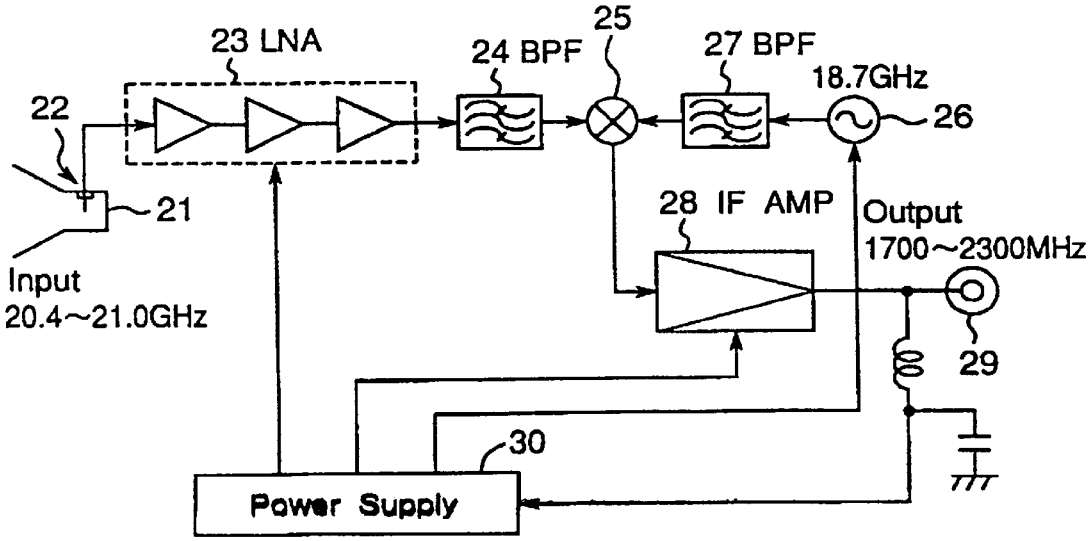
Fig.19 PRIOR ART
FIG. 19 is a circuit block diagram of a LNB for domestic COMETS reception.
Figure 20A:
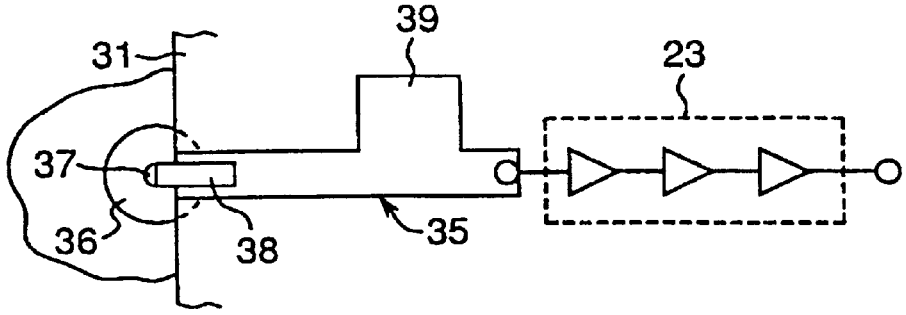
Fig.20A PRIOR ART
FIGS. 20A and 20B are views showing a PWB fixation structure in a prior art low-noise amplifying device for Ka-band reception.
Figure 20B:
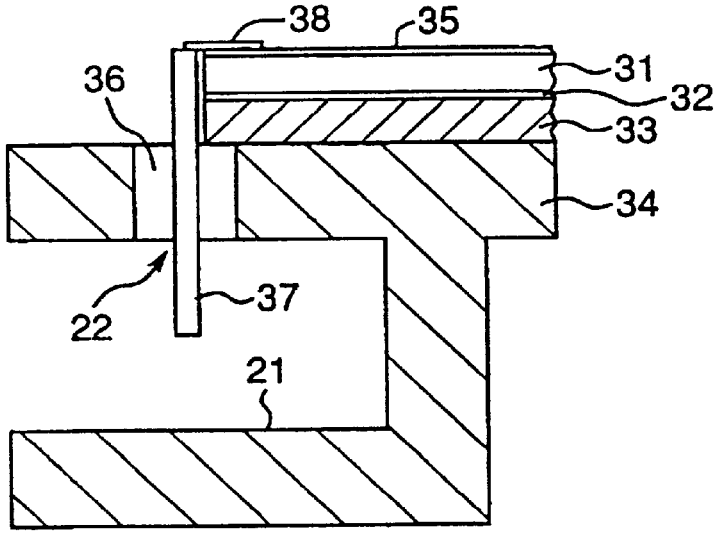
Fig.20B PRIOR ART

FIG. 16 is a modification example of the low-noise amplifying device shown in FIGS. 12A and 12B. A PWB 121, a ground pattern 122, a chassis 123, a microstrip line 124, a metal plate 125 and an antenna pin 126 have the same constructions and operations as those of the PWB 101, ground pattern 102, chassis 103, microstrip line 104, metal plate 105 and antenna pin 106, respectively, shown in FIGS. 12A and 12B.

In the case of the low-noise amplifying device shown in FIGS. 12A and 12B, it is difficult to adjust the volume of the gap portion 110 in the antenna probe 111. Therefore, in the low-noise amplifying device shown in FIG. 16, an external thread is provided on the outer peripheral surface of the dielectric member 127 through which the antenna pin 126 penetrates. An internal thread to be engaged with the external thread of the dielectric member 127 is formed in a hole 123*a* of the chassis 123 in which the dielectric member 127 is buried. With this arrangement, by a simple method of turning the dielectric member 127 to move the dielectric member 127 in the direction of arrow (A), the length of the gap portion 128 is adjusted to allow the characteristics impedance Zgap of the gap portion 128 to be changed.

The invention being thus described, it will be obvious that the same may be obvious that the same may be varied in many ways. Such variations are note be regarded as a departure form the sprit and scope of the invention, and all such modifications as would be obvious to one skilled in the art are intended to be included within the scope of the following claims.

What is claimed is:

1. A low-noise amplifying device which is connected to a low-noise amplifier circuit and which receives a radio wave in a Ka-band of 17 GHz to 23 GHz, comprising:

a planar wiring board having a first end and a second end;

a microstrip extending across an upper surface of said wiring board between said first and second ends of said wiring board, wherein said first end is connected to an antenna probe via one end of said microstrip, and wherein said second end is coupled to said low-noise amplifier circuit via the other end of said microstrip;

a planar ground pattern which is formed on a lower surface of said wiring board; and a waveguide having an upper planar surface which is to be secured to said wiring board so as to sandwich said ground pattern therebetween, wherein said wiring board is fixed to said waveguide upper planar surface by a fixing member located at a central portion of said wiring board and substantially nearer to said antenna probe at said first end than to said second end so as to provide a stable gain and reduced noise figure, thereby achieving a tight adhesion between said ground pattern and said waveguide upper planar surface.

2. The low-noise amplifying device of claim 1, wherein said wiring board is additionally fixed to said waveguide by an additional fixing member substantially near a grounding terminal of an amplifying element constituting said low-noise amplifier circuit.

3. The low-noise amplifying device of claim 1, wherein said fixing member is a screw.

4. The low-noise amplifying device of claim 1, wherein said fixing member is a rivet.

5. The low-noise amplifying device of claim 1, wherein said fixing member is a frame which extends to said upper surface of said wiring board, and wherein said wiring board is inserted between said frame and said waveguide.

6. A low-noise amplifying device of claim 1, wherein said fixing member is a conductive adhesive.

7. The low-noise amplifying device of claim 1, wherein said antenna probe further comprises a coaxial structure of a metal rod and a dielectric member, and wherein a gap is provided between an upper end surface of said dielectric member and said wiring board.

8. The low-noise amplifying device of claim 7, wherein said dielectric member is screwed to said waveguide so as to be able to advance and retreat in an axial direction of said metal rod.

9. The low-noise amplifying device of claim 1, wherein said antenna probe further comprises a coaxial structure of a metal rod and a dielectric member, and wherein an upper end of said metal rod is connected to a tip portion of the microstrip projecting from said first end of said wiring board.

10. A low-noise amplifying device as claimed in claim 1, wherein an upper end of the metal rod in the antenna probe is connected to a tip portion of the microstrip projecting from the end surface of the board.

11. The low-noise amplifying device of claim 1, wherein said antenna probe further comprises a coaxial structure of a metal rod and a dielectric member;

wherein an upper end of said metal rod is bent, and wherein a side surface of said bent portion is connected to a tip portion of said microstrip.

12. The low-noise amplifying device of claim 1, wherein said antenna probe further comprises a coaxial structure of a metal rod and a dielectric member;

wherein an upper end of said metal rod includes a flange, wherein a semicircular cut portion is formed in an end portion of a laminate of said wiring board and said microstrip, wherein a side surface of an upper portion of said metal rod is fitted in said semicircular cut portion, and wherein part of said flange is connected to said end portion of said microstrip.

13. The low-noise amplifying device of claim 9, wherein said tip portion is formed into a taper that reduced in width toward a tip of said microstrip.

14. The low-noise amplifying device of claim 10, wherein said tip portion is formed into a taper that reduced in width toward a tip of said microstrip.

15. The low-noise amplifying device of claim 11, wherein said tip portion is formed into a taper that reduces in width toward a tip of said microstrip.

16. The low-noise amplifying device of claim 12, wherein said end portion of the microstrip is formed into a taper that reduced in width toward a tip of said microstrip.

17. The low-noise amplifying device of claim 1, wherein said fixing member protrudes through said wiring board, ground pattern and waveguide upper surface.

18. A low-noise block downconverter for Ka-band reception, comprising:

a wiring board having a microstrip thereon with first and second ends, wherein said first end of said microstrip is connected to a metal rod of an antenna probe protruding through an end surface of said wiring board, said second microstrip end coupled to a distinct amplifying circuit;

a ground pattern formed on a lower surface of said wiring board; and an upper planar surface of a waveguide which is to be secured to said wiring board so as to sandwich said ground pattern therebetween, wherein said wiring board is fixedly secured to said waveguide upper planar surface by a fixing member protruding through a hole formed in a central portion of said wiring board, and wherein said fixing member is substantially nearer to said antenna probe-microstrip first end connection than to said second end, thereby providing a stable gain and reduced noise figure for the downconverter while achieving tight adhesion between said ground pattern and said waveguide upper planar surface.

19. A low-noise amplifying device, comprising:

a wiring board having a microstrip thereon with first and second ends, wherein said first end of said microstrip is connected to an antenna probe composed of a coaxial structure of a metal rod and a dielectric member, said second microstrip end coupled to a distinct amplifying circuit;

a ground pattern formed on a lower surface of said wiring board;

a portion of a waveguide which is to be secured to said wiring board so as to sandwich said ground pattern therebetween, wherein said dielectric member is ring shaped to encircle said metal rod and is buried within said waveguide; and a gap provided between said dielectric member and wiring board, wherein a volume of said gap is varied to provide matching impedance characteristics at said first and second ends of said microstrip.

20. The device of claim 19, wherein an external thread is provided on an outer peripheral surface of said dielectric member so that said dielectric member may be turned to adjust said gap volume.

* * * * *